US008365571B2

(12) United States Patent
Noguchi et al.

(10) Patent No.: US 8,365,571 B2
(45) Date of Patent: Feb. 5, 2013

(54) PIPE EXPANDING METHOD AND PIPE EXPANDING DEVICE FOR STEEL PIPE

(75) Inventors: Takahiro Noguchi, Yawata (JP); Tatsushi Ito, Hirakata (JP); Fumiaki Kawahara, Hirakata (JP)

(73) Assignee: Komatsu Ltd., Tokyo (JP)

( * ) Notice: Subject to any disclaimer, the term of this patent is extended or adjusted under 35 U.S.C. 154(b) by 610 days.

(21) Appl. No.: 12/282,903

(22) PCT Filed: May 14, 2007

(86) PCT No.: PCT/JP2007/059834

§ 371 (c)(1),
(2), (4) Date: Sep. 15, 2008

(87) PCT Pub. No.: WO2007/132799

PCT Pub. Date: Nov. 22, 2007

(65) Prior Publication Data

US 2009/0090159 A1 Apr. 9, 2009

(30) Foreign Application Priority Data

May 15, 2006 (JP) ..... 2006-134815

(51) Int. Cl.
*B21D 39/08* (2006.01)
*B21C 37/16* (2006.01)

(52) U.S. Cl. ..... 72/370.06; 72/370.24

(58) Field of Classification Search ..... 72/367.1, 72/370.01–370.03, 370.04, 370.06, 370.1, 72/370.23, 370.24, 370.26, 393
See application file for complete search history.

(56) References Cited

U.S. PATENT DOCUMENTS

| | | | | |
|---|---|---|---|---|
| 4,198,844 | A * | 4/1980 | Lowe et al. | 72/393 |
| 4,733,551 | A * | 3/1988 | Bryant et al. | 72/393 |
| 5,836,197 | A * | 11/1998 | McKee et al. | 72/402 |
| 6,453,714 | B2 * | 9/2002 | Kido et al. | 72/297 |
| 6,581,433 | B2 * | 6/2003 | Otsuka et al. | 72/370.06 |
| 2004/0144152 | A1 * | 7/2004 | Wu | 72/370.06 |
| 2007/0256467 | A1 | 11/2007 | Viegner, Jr. et al. | |

FOREIGN PATENT DOCUMENTS

| | | | |
|---|---|---|---|
| JP | 54-52664 | A | 4/1979 |
| JP | 09-122747 | A | 5/1997 |
| JP | 2002-346664 | A | 12/2002 |
| JP | 2003-311343 | A | 11/2003 |
| JP | 2006-272350 | A | 10/2006 |
| WO | WO-2005/061148 | A1 | 7/2005 |

OTHER PUBLICATIONS

Notice of Allowance of corresponding Japanese Application No. 2008-515542 dated Dec. 20, 2012.

* cited by examiner

*Primary Examiner* — Debra Sullivan
(74) *Attorney, Agent, or Firm* — Global IP Counselors

(57) ABSTRACT

A pipe expanding device inserts a pipe expanding punch into an opening end portion of a steel pipe with a special shape in the state where the opening end portion of the steel pipe with a special shape is pressed in an insertion direction of the punch.

20 Claims, 9 Drawing Sheets

(a)

(b)

(a)

(b)

(a)

(b)

(a)

| θ | | 15° | 30° |
|---|---|---|---|
| Expansion Ratio | 10% | ○ | × |
| | 20% | × | × |

Formation Result by Conventional Pipe Expanding Method
○ : Formation is Good
× : Formation is No Good (b)

| θ | | 15° | 30° |
|---|---|---|---|
| Expansion Ratio | 10% | ○ | ○ |
| | 20% | ○ | × |

Formation Result by Pipe Expanding Method of Embodiment
○ : Formation is Good
× : Formation is No Good (a)

(b)

(c)

PIPE EXPANDING METHOD AND PIPE EXPANDING DEVICE FOR STEEL PIPE

CROSS-REFERENCE TO RELATED APPLICATIONS

This U.S. national stage application claims priority under 35 U.S.C. §119(a) to Japanese Patent Application No. 2006-134815, filed in Japan on May 15, 2006. The entire disclosure of Japanese Patent Application No. 2006-134815 is hereby incorporated herein by reference.

TECHNICAL FIELD

The present invention relates to a pipe expanding method and a pipe expanding device for a steel pipe that form an expanded pipe part at an end of a steel pipe with a special shape or the like.

BACKGROUND ART

Conventionally, a method has been used in which a punch is pressed from one end of a steel pipe to form an expanded pipe part.

For example, Japanese Patent Laid-Open Publication TOKUKAI No. 2002-346664 (published on Dec. 3, 2002) discloses a pipe expanding method for an end of a metal pipe that uses a punch with a taper angle in a range 15 to 30 degrees, and a metal pipe holder having a tapered portion with the same taper angle as the taper angle of the punch so that the punch is pressed from the end of the metal pipe to expand the end of the metal pipe.

According to this pipe expanding method, a pipe end of a metal pipe can be efficiently expanded that is formed of stainless steel or and high-strength steel with a high yield strength and a high work hardening coefficient without deformation such as buckling or flattened shape.

SUMMARY OF THE INVENTION

However, the aforementioned known pipe expanding method for a steel pipe has the following problems.

That is, in the case of pipe expanding for a round steel pipe, since the thickness of such a round steel pipe will be uniformly reduced as the round steel pipe is getting widely expanded, the molding limit range is wide, and the degree of molding difficulty is not high. Accordingly, in this case, problems do not arise even in the molding method that is disclosed in the aforementioned publication. However, in the case of pipe expanding for a steel pipe with a special shape which has a generally rectangular shape in section and surfaces parallel to each other, since it is difficult to expand the steel pipe with a special shape so as to uniformly reduce the thickness of the steel pipe with a special shape, the molding limit range is limited, and the degree of molding difficulty is high. For this reason, if the molding method that is disclosed in the aforementioned publication is applied to this case, problems will arise.

It is an object of the present invention to provide a pipe expanding method for a steel pipe and a pipe expanding device for a steel pipe capable of reducing the degree of molding difficulty even in the case of pipe expanding for a steel pipe with a special shape.

A pipe expanding method for a steel pipe according to the first aspect of the present invention includes inserting a punch for pipe expanding from an opening end portion of the steel pipe, and pressing the opening end portion in an insertion direction of the punch when the punch is inserted from the opening end portion of the steel pipe.

In this configuration, in the case of pipe expanding for a steel pipe, to expand the inner diameter of the steel pipe by inserting the pipe expanding punch into the steel pipe, the opening end portion of the steel pipe that accommodates the aforementioned punch is pressed in the insertion direction of the punch.

Accordingly, when the thickness of the steel pipe is getting reduced as the steel pipe is getting widely expanded since the opening end portion that accommodates the punch is pressed in the insertion direction of the punch, it is possible to suppress that the thickness of the expanded steel pipe is excessively reduced in a particular location. As a result, molding defectiveness can be suppressed. For this reason, the molding limit of pipe expanding for a steel pipe can be wider. Consequently, it is possible to provide a molding method that is available in pipe expanding for a steel pipe with a special shape, which has a generally rectangular shape in section and surfaces parallel to each other, for example.

A pipe expanding method for a steel pipe according to the second aspect of the present invention is the pipe expanding method for a steel pipe according to the first aspect of the present invention, further including expanding one side of the steel pipe in cross-section in the state where parallel surfaces of the steel pipe are maintained in parallel while the opening end portion of the steel pipe is pressed in the insertion direction of the punch.

In this configuration, a steel pipe with a special shape is expanded which has a generally rectangular shape or the like in section and surfaces parallel to each other, for example.

Generally, in the case where a steel pipe with a special shape is expanded in the state where such parallel surfaces of the steel pipe are maintained in parallel, as compared with the case where a round steel pipe is expanded, the thickness of the expanded steel pipe likely excessively decreases in a particular location. As a result, in this case, a problem arises in which molding defectiveness such as rupture likely occurs.

In the pipe expanding method for a steel pipe according to the invention, since the opening end portion of the steel pipe to be expanded is formed in the state where the opening end portion is pressed in the insertion direction of the punch, even in the case of steel pipes with special shapes, which are generally considered difficult to be expanded, the steel pipes with special shapes can be expanded without rapture and the like.

A pipe expanding method for a steel pipe according to the third aspect of the present invention is the pipe expanding method for a steel pipe according to the first or second aspect of the present invention, and the pressing of the opening end portion includes pressing a part of the opening end portion of the steel pipe on the side to be expanded.

In this configuration, in the state where the pipe expanding punch is getting deeply inserted into the steel pipe, the part of the opening end portion of the steel pipe on the side to be expanded is pressed.

Since the part of the opening end portion of the steel pipe on the one side where its thickness will be reduced in pipe expanding is thus pressed in the same direction as the insertion direction of the punch, it is possible to more effectively suppress that the thickness is excessively reduced in the pipe expanding which in turn may cause molding defectiveness.

A pipe expanding method for a steel pipe according to the fourth aspect of the present invention is the pipe expanding method for a steel pipe according to the third aspect of the present invention, and pressing of the opening end portion includes pressing the part of the opening end portion of the steel pipe on the side to be expanded by using a generally U-shaped mold.

In this configuration, in the state where the pipe expanding punch is getting deeply inserted into the steel pipe, the part of the opening end portion of the steel pipe on the side to be expanded is pressed by using the generally U-shaped mold in pressing operation.

Accordingly, it is possible to effectively suppress that the thickness of the part, which will be to be thinner, is excessively reduced in by the pipe expanding which in turn may cause molding defectiveness such as rapture.

A pipe expanding method for a steel pipe according to the fifth aspect of the present invention is the pipe expanding method for a steel pipe according to any one of the first to fourth aspects of the present invention, and the pressing of the opening end portion includes increasing a pressing force which presses the opening end portion of the steel pipe when a thickness of the steel pipe starts decreasing.

In this configuration, the pressing force that presses the opening end portion of the steel pipe in insertion of the punch into the steel pipe is controlled to start increasing at the timing where the thickness of the steel pipe starts decreasing.

In this configuration, the timing where the thickness of the steel pipe starts decreasing is specified based on the control of the stroke of the punch to be inserted, the control of the insertion pressure of the punch, the control of the period and the speed of the punch to be inserted, and the like.

Accordingly, since the opening end portion of the steel pipe is pressed by a larger force when the thickness of the steel pipe starts decreasing, it is possible to suppress excess thickness reduction of the steel pipe in a particular location, which may cause molding defectiveness, and additionally the steel pipe can be efficiently expanded in desired conditions.

A pipe expanding method for a steel pipe according to the sixth aspect of the present invention is the pipe expanding method for a steel pipe according to the fifth aspect of the present invention, and the pressing of the opening end portion includes increasing the pressing force on the opening end portion to a first predetermined pressure, holding the first predetermined pressure until the thickness of the steel pipe starts decreasing, and increasing the pressing force on the opening end portion to a second predetermined pressure when the thickness starts decreasing.

In this configuration, the first and second pressures are specified, and the opening end portion of the steel pipe is pressed in a multi-step manner. Specifically, before the thickness of the steel pipe starts decreasing in the state where a die is getting deeply inserted into the opening end portion of the steel pipe, the pressing force is held constant at the first predetermined pressure. After that, when the thickness of the steel pipe starts decreasing, the pressing force on the opening end portion is controlled to increase to the second pressure.

Accordingly, it is possible to prevent that an excess pressure is applied to the opening end portion before the thickness of the steel pipe starts decreasing. As a result, the pipe can be expanded at a high degree of precision without deformation and the like of the opening end portion.

A pipe expanding method for a steel pipe according to the seventh aspect of the present invention is the pipe expanding method for a steel pipe according to any one of the first to sixth aspects of the present invention, and the steel pipe has a special (out-of-round) shape in cross-section.

In this configuration, a steel pipe with a special shape in section is expanded. Such a steel pipe with a special shape in section has a generally rectangular shape in section and surfaces parallel to each other, for example. Note that the aforementioned special shape in section refers to a noncircular shape in section. This means that the present invention is effective particularly in the case where a pipe with a special shape in section is expanded rather than the case of a pipe with a round shape in section, which is getting uniformly thinner when expanded and likely has good moldability.

For this reason, in the case where a pipe is formed by the aforementioned pipe expanding method, even if the pipe is a steel pipe with a special shape, which is generally the difficult to be expanded, it is possible to suppress that molding defectiveness occurs. Additionally, the steel pipe can be desirably expanded.

A pipe expanding device for a steel pipe according the eighth aspect of the present invention includes a pipe expanding punch, an insertion mechanism, and a pressing portion. The insertion mechanism is configured and arranged to insert the punch from an opening end portion of the steel pipe. When the punch is inserted from the opening end portion of the steel pipe, the pressing portion presses the opening end portion in the insertion direction of the punch.

In this configuration, in the case of pipe expanding for a steel pipe, to expand the inner diameter of the steel pipe by inserting the pipe expanding punch into the steel pipe, the opening end portion of the steel pipe that accommodates the aforementioned punch is pressed in the insertion direction of the punch.

Accordingly, when the thickness of the steel pipe is getting reduced as it is getting widely expanded since the opening end portion that accommodates the punch is pressed in the insertion direction of the punch, it is possible to suppress that the thickness of the expanded steel pipe is reduced in a particular location. As a result, molding defectiveness can be suppressed. For this reason, the molding limit of pipe expanding for a steel pipe can be wider. Consequently, it is possible to provide a pipe expanding device that is available in pipe expanding for a steel pipe with a special shape, for example.

A pipe expanding device for a steel pipe according to the ninth aspect of the present invention is the pipe expanding device for a steel pipe according to the eighth aspect of the present invention, the device further comprises a control unit configured to control the insertion mechanism. The control unit is configured to control the pressing portion so that, the pressing force of the pressing portion is increased which presses the opening end portion when the punch is getting deeply inserted into the opening end portion of the steel pipe and the thickness of the steel pipe starts decreasing.

In this configuration, the pressing force of the pressing portion in insertion of the punch into the steel pipe is controlled to increase at the timing where the thickness of the steel pipe starts decreasing.

In this configuration, the timing the thickness of the steel pipe starts decreasing is specified based on the control of the stroke of the punch to be inserted, the control of the insertion pressure of the punch, the control of the period and the speed of the punch to be inserted, and the like.

Accordingly, since the opening end portion of the steel pipe is pressed by a larger force when the thickness of the steel pipe starts decreasing, it is possible to suppress excess thickness reduction of the steel pipe which in turn may cause molding defectiveness, and additionally the steel pipe can be efficiently expanded in desired conditions.

A pipe expanding device for a steel pipe according to the tenth aspect of the present invention is the pipe expanding device for a steel pipe according to the eighth or ninth aspect of the present invention, and the pressing portion is a generally U-shaped mold.

In this case, in the state where the pipe expanding punch is getting deeply inserted into the steel pipe, the part of the opening end portion of the steel pipe on the side to be expanded is pressed by using the generally U-shaped mold in pressing operation.

Accordingly, it is possible to suppress excess thickness reduction of the part to be thinner caused by the expansion which in turn may cause molding defectiveness.

A pipe expanding device for a steel pipe according to the eleventh aspect of the present invention is the pipe expanding device for a steel pipe according to any one of the eighth to tenth aspects of the present invention, and the punch includes first and second sections. The first section has a first surface parallel to the direction in which the punch is inserted from the opening end portion of the steel pipe. The second section has second and third surfaces parallel to the first surface of the first section. The second and third surfaces are spaced away at different distances from the first surface of the first section. The second and third surfaces are connected through a tapered section.

In this configuration, a steel pipe with a special shape is expanded by using the punch that includes the first and the second sections that has the surfaces parallel to each other. The second section has the plurality of surfaces parallel to the surfaces in the first section. The plurality of surfaces are connected each other through the tapered sections.

Generally, in the case where a steel pipe with a special shape is expanded in the state where the parallel surfaces of the steel pipe are maintained in parallel by using the thus-shaped punch, as compared with the case where a round steel pipe is expanded, the thickness of the expanded steel pipe likely is reduced in a particular location. As a result, in this case, a problem arises in which molding defectiveness such as rupture likely occurs.

In the pipe expanding device for a steel pipe according to the invention, since the opening end portion of the steel pipe to be expanded is formed in the state where the opening end portion is pressed in the insertion direction of the punch by the pressing portion, even in the case of steel pipes with special shapes, which are generally considered difficult to be expanded, the steel pipes with special shapes can be expanded without rapture and the like.

BRIEF DESCRIPTION OF DRAWINGS

FIGS. 7A and 7B show tables of examination results of a conventional pipe expanding method and the pipe expanding method of the present invention in which expansion ratios and taper angles are changed.

DETAILED DESCRIPTION OF THE PREFERRED EMBODIMENTS

With reference to FIGS. 1 to 9, the following description will describe a pipe expanding method for a steel pipe and a pipe expanding device for a steel pipe according to one embodiment of the present invention.

Configuration of Pipe Expanding Device 10

Figure 1:
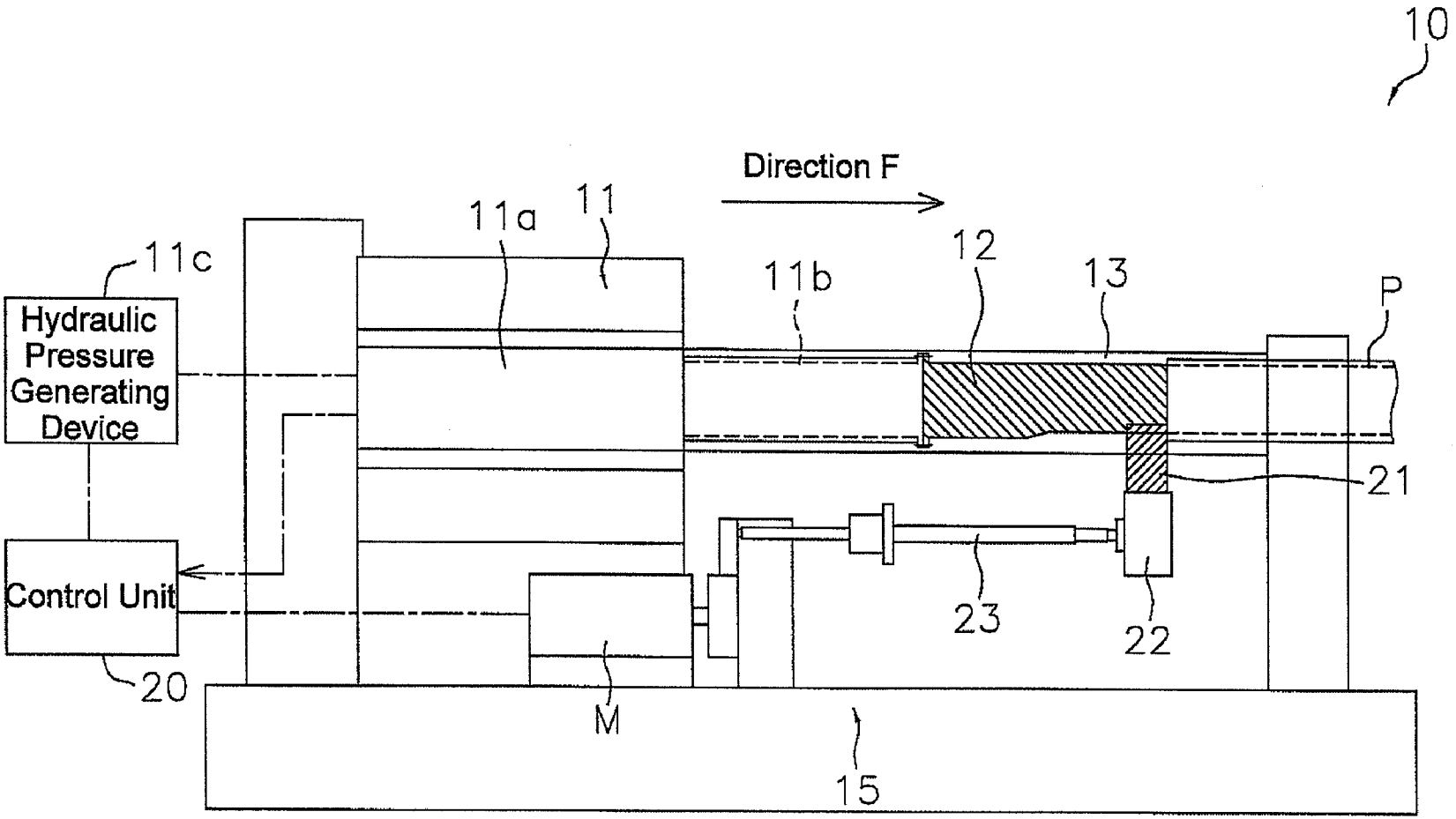
FIG. 1 is a side view showing the configuration of a pipe expanding device to which a pipe expanding method for a steel pipe according to one embodiment of the present invention is adopted.

A pipe expanding device 10 according to this embodiment inserts a pipe expanding punch 12 with a predetermined shape into a steel pipe P with a special(irregular) shape to expand the steel pipe P. As shown in FIG. 1, the device 10 includes a main cylinder (insertion mechanism) 11, the pipe expanding punch 12, a die 13, a side pressure device (pressing portion) 15 that has a side mold 21, and a control unit 20.

The steel pipe P with a special shape is a member to be formed as a frame support pole that will compose a cab that is installed on a construction machine such as a hydraulic excavator. A round steel pipe with a round shape in section is formed into a special shape in section by roll forming (see FIG. 9).

The main cylinder 11 includes a cylinder unit 11*a*, a cylinder rod 11*b*, and a hydraulic pressure generating device 11*c*. The main cylinder 11 exerts a pressing force that is applied by the hydraulic pressure generating device 11*c* on the punch 12 through the cylinder rod 11*b*, and the punch 12 is pushed into the steel pipe P with a special shape that is fixedly arranged.

Figure 2:
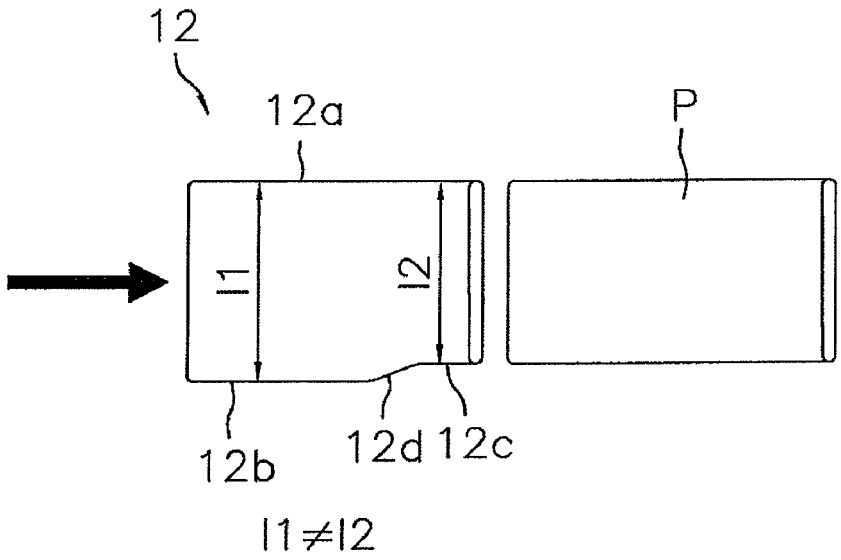
FIGS. 2A and 2B are side views showing processes in the case where a punch is inserted into a steel pipe with a special shape.
Figure 2:
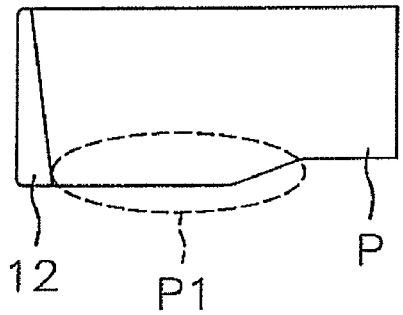

The punch 12 is a member to be inserted into the steel pipe P with a special shape to form an expanded part P1 in the steel pipe P with a special shape. As shown in FIGS. 2(*a*) and 2(*b*), the punch 12 includes a first surface (first section) 12*a*, a second surface (second section) 12*b* and a third surface 12*c* that are parallel to the first surface 12*a*, and a tapered section 12*d*. The second surface 12*b* and the third surface 12*c* are spaced at different distances 11 and 12 (11≠12) away from the first surface 12*a*. Thus, a portion of the punch 12 where a distance from the first surface 12*a* to an opposing surface is the largest (i.e., the distance 11 in the example of FIGS. 2(*a*) and 2(*b*)) corresponds to a maximum diameter portion. The second surface 12*b* and the third surface 12*c* are connected through the tapered section 12*d*. In the case where the pipe is expanded by using this punch 12, in the state where the surfaces of the pipe that are parallel to the first surface 12*a* and the second surface 12*b* are maintained parallel to the first surface 12*a* and the second surface 12*b*, a part of one of the surfaces can be expanded. In this case, a flange portion that is formed at the rear end of the punch 12 is coupled to a flange portion that is formed at the fore end of the cylinder rod 11 *b*.

Figure 3:
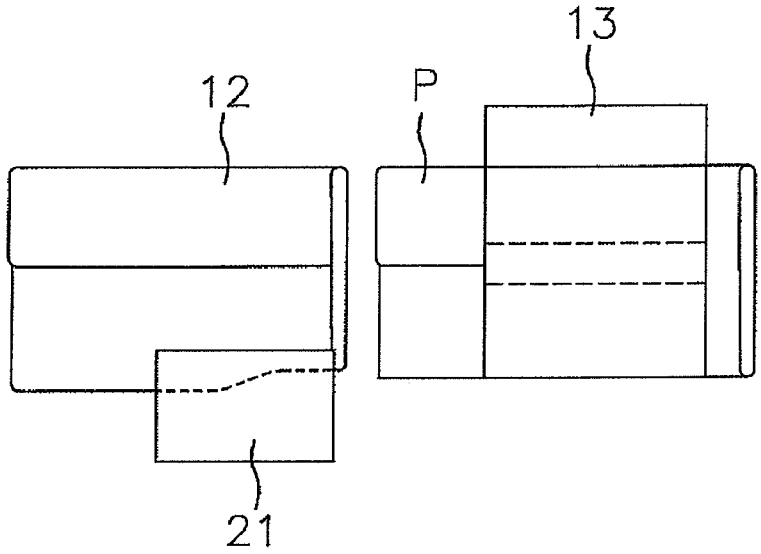
FIG. 3A is a front view showing the positional relationship of a side mold, the punch, the steel pipe with a special shape, and a die in the case where the punch is inserted into the steel pipe with a special shape.
FIG. 3B is a cross-sectional view of the side mold, the punch, the steel pipe with a special shape, and the die as viewed from the lateral side in FIG. 3A.
Figure 3:
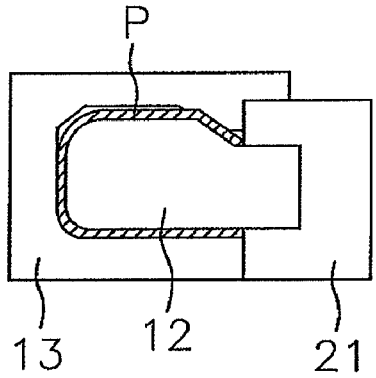

As shown in FIGS. 3(*a*) and 3(*b*), the die 13 is arranged so as to surround the outer periphery of the steel pipe P with a special shape as an object to be expanded together with the side mold 21 discussed later. The die 13 is arranged along the steel pipe P with a special shape into which the punch 12 is inserted. Accordingly, moldability can be improved in pipe expanding.

The side pressure device 15 is a mechanism that exerts a pressing force on one opening end portion of the steel pipe P with a special shape as an object to be expanded in the same direction as the insertion direction of the punch 12. As shown in FIG. 1, the side pressure device 15 includes the side mold 21, a mold retaining section 22, a shaft 23, and a motor M. The side mold 21 is mounted to the mold retaining section 22 that is attached to the fore end of the shaft 23. The mold retaining section 22 is moved forward together with the shaft 23 in a direction of F by the rotational driving force that is conveyed from the motor M, and thus exerts a pressing force on the opening end portion of the steel pipe P with a special shape. In addition, the motor M is an AC servo motor. The motor M is controlled in a feedforward control manner by the control unit 20 to exert an appropriate pressing force on the opening end portion of the steel pipe P with a special shape based on the stroke and the speed of the punch 12 in the main cylinder 11 when the punch 12 is moved frontward.

As discussed above, the control unit 20 receives the stroke and the speed of the punch 12 in the main cylinder 11 when the punch 12 is moved frontward, and thus controls the rotation of the motor M so as to move the side mold 21 forward at an optimal pressing force of using the side pressure device 15. In addition, the control unit 20 is connected also to the main cylinder 11, as shown in FIG. 1. The control unit 20 receives the amplitude of pressing force from a load detecting sensor (not shown) that is installed in the main cylinder 11, and thus determines the timing where the pressing force of the side mold 21 starts increasing as discussed later.

Flow of Pipe Expanding by Pipe Expanding Device 10

Figure 4:
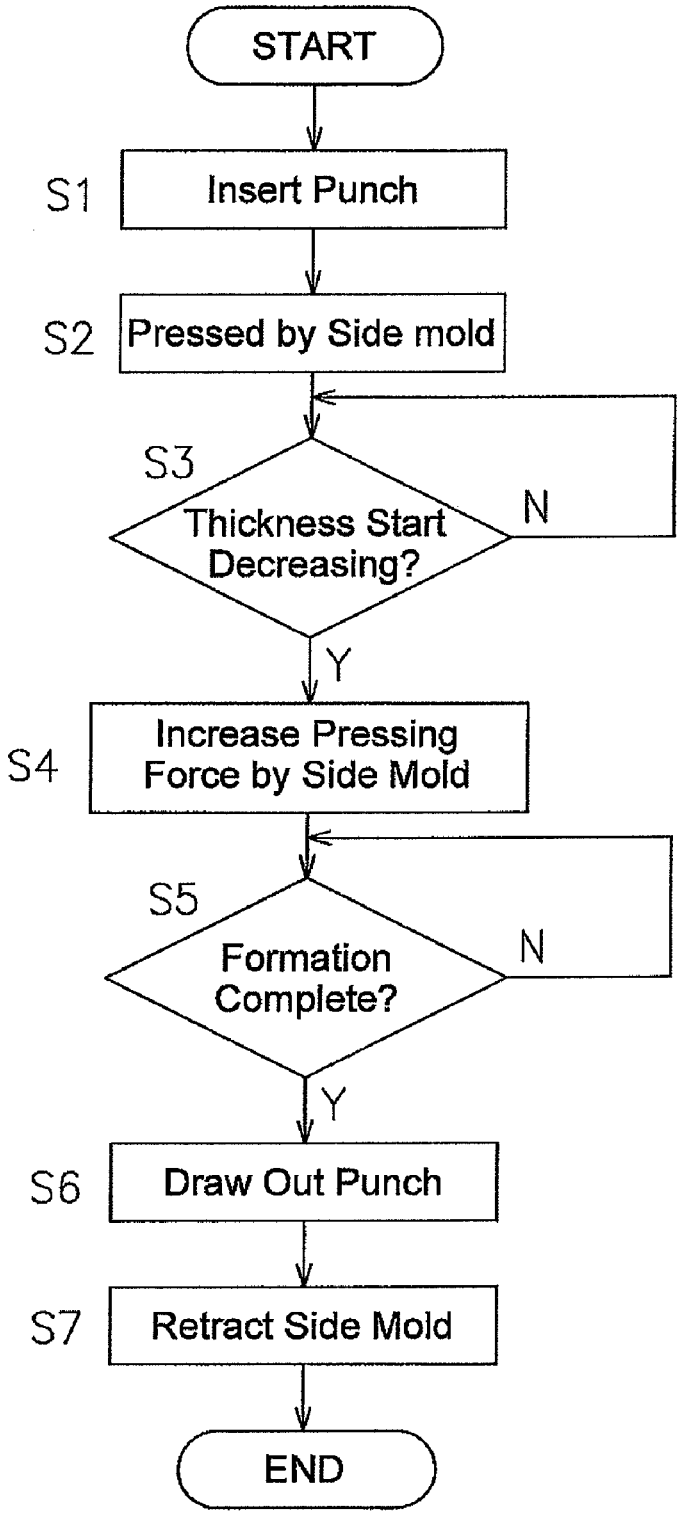
FIG. 4 is a flow chart showing the flow of the pipe expanding method by using the pipe expanding device shown in FIG. 1.

In this embodiment, the steel pipe P with a special shape is expanded by using the following steps according to a flow chart shown in FIG. 4 in the pipe expanding device 10 that is configured as discussed above.

That is, in the pipe expanding device 10 according to this embodiment, in Step S1, as shown in FIG. 3 (*a*), the main cylinder 11 (see FIG. 1) is extended to insert the punch 12 into the steel pipe P with a special shape that is set to the die 13.

Subsequently, in Step S2, based on the insertion timing of the punch 12 into the steel pipe P with a special shape, and on the insertion stroke of the punch 12, the side mold 21 is moved frontward by the motor M in the state where the side mold 21 contacts the opening end portion of the steel pipe P with a special shape on the punch 12 insertion side to press the opening end portion of the steel pipe P with a special shape.

In this step, the punch 12 is inserted into the steel pipe P with a special shape, as shown in FIG. 3 (*b*). The side mold 21 then presses a part to be expanded of the steel pipe P with a special shape in section.

Figure 5:
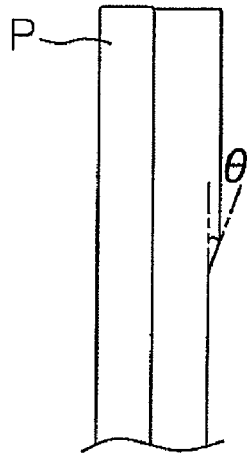
FIGS. 5A and 5B are a front view and a cross-sectional view, respectively, showing the steel pipe with a special shape that is expanded after the insertion of the punch.
Figure 5:
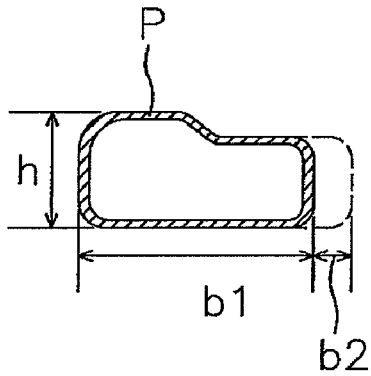

Subsequently, in Step S3, in the process where the punch 12 is getting deeply inserted into the steel pipe P with a special shape, until the thickness of the steel pipe with a special shape P starts decreasing due to expansion, the punch 12 is continuously inserted, and the side mold 21 continuously presses the steel pipe P with a special shape. In this step, as shown in FIGS. 5(*a*) and 5(*b*), when the punch 12 is inserted which includes the tapered section with taper angle θ, the steel pipe P with a special shape with height h and width b1 in section is expanded, and as a result the steel pipe P with a special shape has a width (b1+b2). Additionally, the side mold 21 exerts a pressing force locally on this expanded part.

Here, the expansion ratio of the steel pipe P with a special shape is calculated based on the following relation formula (1).

$$\text{Expansion Ratio}=b2/b1 \quad (1)$$

Subsequently, when the thickness of the steel pipe P with a special shape starts decreasing, the sequence goes to Step S4. Although the control unit 20 temporarily controls the exerted pressing force of the side mold 21 to be fixed at a predetermined value, the control unit 20 controls the pressing force of the side mold 21 to increase again in step S4, as shown in FIG. 6.

In this case, the start of the thickness reduction of the steel pipe P with a special shape can be determined based on detection of timing A where the pressing force of the punch 12 that is inserted into the steel pipe P with a special shape stops increasing. That is, in the process where the punch 12 is getting deeply inserted into the steel pipe P with a special shape, in order to insert the punch 12 with an outer diameter larger than the inner diameter of the steel pipe P with a special shape with a predetermined insertion speed being maintained, it is necessary to insert the punch 12 with the pressing force of the punch 12 being increased. After that, when the thickness of the steel pipe P with a special shape starts decreasing, the pressing force of the punch 12 stops increasing and levels off near a predetermined value. For this reason, the timing A is detected in which the pressing force of the punch 12 that is inserted into the steel pipe P with a special shape stops increasing. This detection can specify timing C to start increase of the pressing force of the side mold 21. Thus, the pressing force that presses the opening end portion of the steel pipe P with a special shape is increased nearly at the same timing as the start of the thickness reduction. This can prevent that the thickness of the steel pipe is excessively reduced in a particular location which in turn may cause molding defectiveness.

Figure 6:
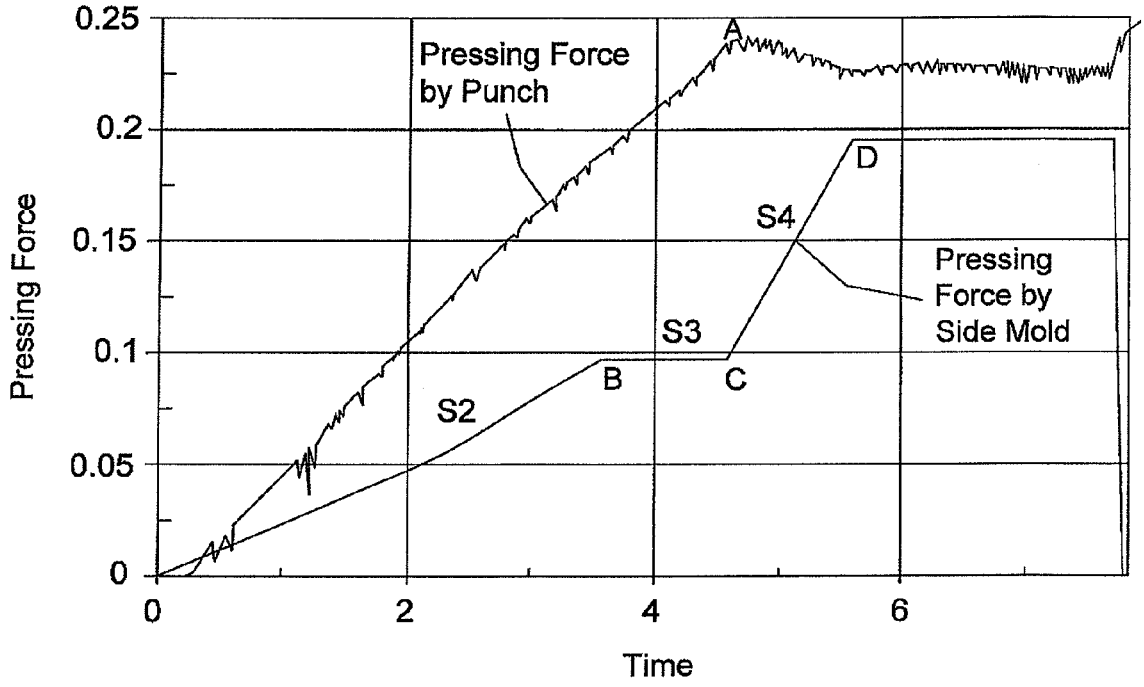
FIG. 6 is a graph showing the relationship of the insertion stroke of the punch and the pressing force of the side mold at expanding a steel pipe by the pipe expanding device shown in FIG. 1.

In addition, as shown in FIG. 6, when the aforementioned pressing force of the side mold 21 is increased and reaches a predetermined maximum value D, the pressing force of the side mold 21 is controlled fixed at a constant value.

Subsequently, the punch 12 and the side mold 21 continuously press the pipe. When the main cylinder 11 moves the punch 12 to a predetermined position, it is determined that the pipe is completely formed, in Step S5. Subsequently, the sequence goes to Step S6.

Subsequently, in Step S6, the punch 12 that is inserted to the steel pipe P with a special shape is drawn from the steel pipe P with a special shape. Then, in Step S7, the side mold 21 stops pressing the steel pipe P with a special shape and is retracted laterally from the side of the steel pipe P with a special shape.

In the pipe expanding device 10 for the steel pipe P with a special shape according to this embodiment, as discussed above, the punch 12 is getting deeply inserted into the steel pipe P with a special shape in the state where the part of opening end portion of the steel pipe P with a special shape is pressed by using the side mold 21.

This can prevent that the steel pipe P with a special shape which is expanded with reducing the thickness thereof by the insertion of the punch 12 is excessively reduced the thickness in a particular location which in turn may cause molding defectiveness, the thickness of the expanded steel pipe P with a special shape being reduced by insertion of the punch 12. As a result, it is possible to improve moldability in pipe expanding.

Figures 7, 8:
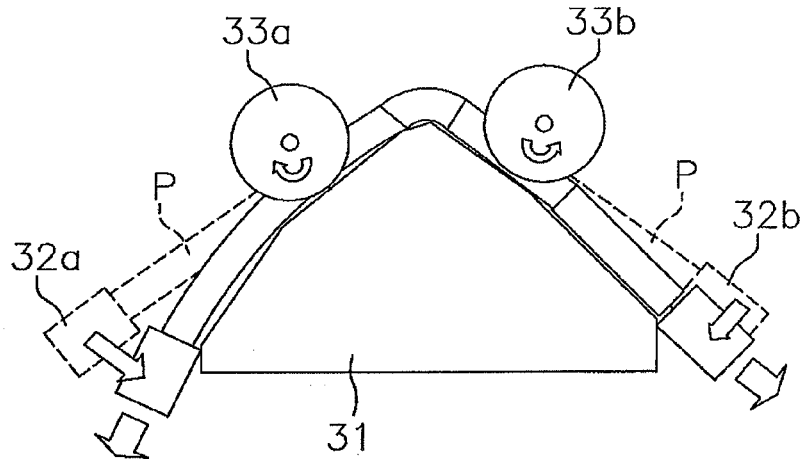
FIG. 8 shows the state where the steel pipe with a special shape that is expanded by the pipe expanding device shown in FIG. 1 is bent in a stretch bending process.
Figure 9:
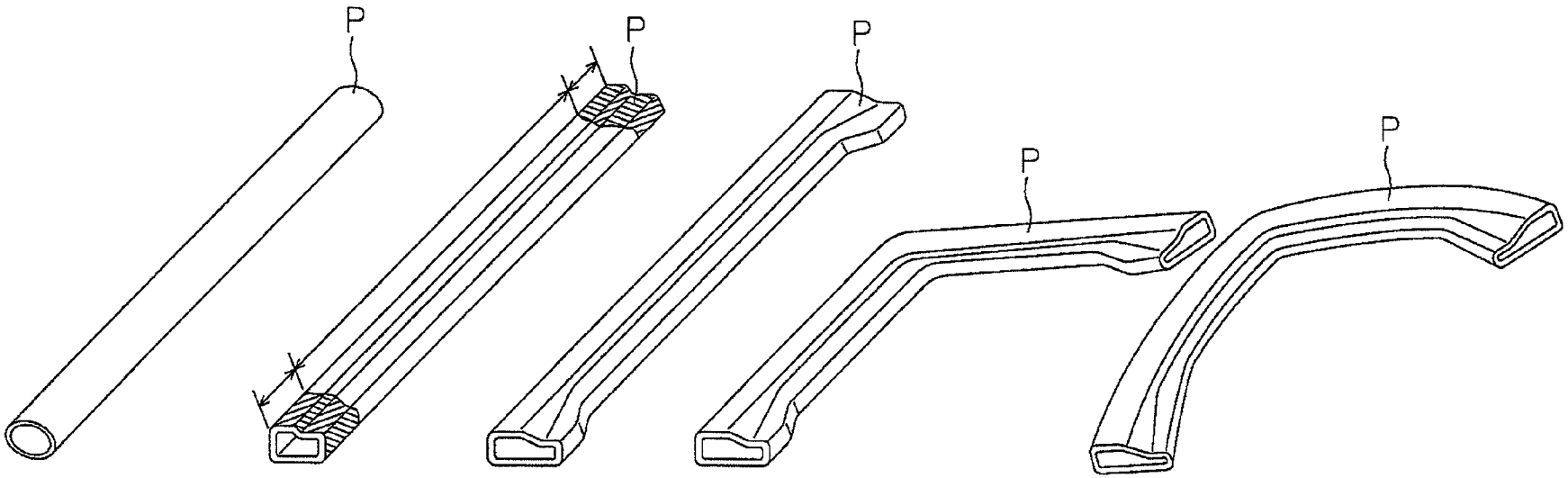
FIGS. 9A to 9E show the variations of the shape of the steel pipe with a special shape from the expansion process by the pipe expanding device shown in FIG. 1 to the stretch bending process.

FIGS. 7(*a*) and 7(*b*) are tables showing the result in which pipes are formed by the pipe expanding method according to this embodiment (see FIG. 7(*b*)), and the result in which pipes are formed by a conventional pipe expanding method (see FIG. 7(*a*)).

As for the conventional pipe expanding method, as shown in FIG. 7(*a*), it is found that only one examination pipe piece is properly formed with the conditions of a taper angle θ 15 degrees and an expansion ratio 10%, and that molding defectiveness occurs in the cases of examination pipe pieces with the conditions of a taper angle 30 degrees, and an examination pipe pieces with the conditions of a taper angle 15 degrees and an expansion ratio 20%. As for examination pipe pieces that are formed by the pipe expanding method according to this embodiment, although molding defectiveness occurs in the cases of an examination pipe piece with the conditions of a taper angle 30 degrees and an expansion ratio 20%, an examination pipe piece with the conditions of a taper angle 15 degrees and an expansion ratio 20%, and an examination pipe piece with the conditions of a taper angle 30 degrees and an expansion ratio 10% are expanded without molding defectiveness.

As discussed above, in this embodiment, since the punch 12 is getting deeply inserted into the steel pipe P with a special shape in the state where the opening end portion of the steel pipe P with a special shape is pressed by the side mold 21, the molding limit in pipe expanding can be wider, and as a result it is possible to suppress that molding defectiveness occurs.

Flow of Stretch Bending Processes

In this embodiment, after the both ends of the steel pipe P with a special shape are expanded by the aforementioned method, the procedure goes to a stretch bending process. In the stretch bending process, the expanded parts of the steel pipe P with a special shape are retained, and the steel pipe P with a special shape is bent until the steel pipe P with a special shape is deformed in a desired shape.

Specifically, as shown in FIG. 8, the retaining members 32*a* and 32*b* retain the both expanded ends of the steel pipe P with a special shape, and the steel pipe P with a special shape is brought in the state where the steel pipe P with a special shape is bent along the inside mold 31 (draw bending). In this case, the steel pipe P with a special shape is deformed in a curved shape with a large radius by using roll molds 33*a* and 33*b*.

As discussed above, as shown in FIGS. 9(*a*) to 9(*e*), after a round steel pipe with a generally round shape in section (see FIG. 9(*a*)) is formed into a special shape in section (see FIG. 9(*b*)) by using roll forming, the both end parts with the aforementioned special shape in section is expanded (see FIG. 9(*c*)). Subsequently, after the expanded parts are retained and the steel pipe P with a special shape is bent (see FIG. 9(*d*)), the steel pipe P with a special shape is deformed in a curved shape with a large radius in the aforementioned stretch bending process (see FIG. 9(*e*)).

Accordingly, as compared with a conventional formation process for a cab frame support pole, a highly precise support pole can be formed. In addition, since, after stretch bending, the expanded member can be used only by cutting small parts of the expanded ends, as compared with a conventional method in which both ends of a pipe are crushed to be retained, the amounts of the parts to be cut after formation are reduced. Therefore, it is possible to improve the production yield of frame support poles.

(1) In the pipe expanding device 10 according to this embodiment, as shown in FIGS. 3(*a*) and 3(*b*), the punch 12 is inserted into one opening end portion of the pipe P with a special shape in the state where the aforementioned opening end portion of the pipe P with a special shape is pressed by the side mold 21 in the same direction as the pressing direction of the punch 12.

Accordingly, in the case where the thickness of the steel pipe P with a special shape is getting reduced in pipe expanding, since the opening end portion of the pipe is pressed, it is possible to suppress that the thickness of the pipe is excessively reduced in a particular location. For this reason, the molding limit of pipe expanding for the steel pipe P with a special shape can be wider. Consequently, it is possible to provide a pipe expanding method that is available in pipe expanding for a steel pipe with a special complex shape in section.

(2) In the steel pipe expanding device 10 according to this embodiment, as shown in FIG. 2(*a*), etc., a pipe is expanded by using the punch 12 that has the first surface 12*a*, and the second and third surfaces 12*b* and 12*c* that are parallel to each other.

Accordingly, although the steel pipe P with a special shape is the that the thickness of the steel pipe P with a special shape is likely excessively reduced in a particular location and that molding defectiveness likely occurs, since the opening end portion of the steel pipe P with a special shape is pressed by using the aforementioned side mold 12, even in the case of the steel pipe P with a special shape, in the state where the parallel surfaces of the pipe are maintained parallel, only one side (second and third surfaces 12*b* and 12*c*) can be expanded.

(3) In the steel pipe expanding device 10 according to this embodiment, the side mold 21 partially presses a part of an opening end portion of the steel pipe P with a special shape on the side to be expanded.

Accordingly, it is possible to suppress that the thickness of the pipe is excessively reduced in a particular location in pipe expanding which in turn may cause molding defectiveness. In addition to this, unnecessary stress is not generated in parts other than the part to be expanded. Therefore, it is possible to improve moldability in pipe expanding.

(4) In the steel pipe expanding device 10 according to this embodiment, as shown in FIG. 3(*b*), the side mold 21 with a generally U-shaped in section is used as a member that presses the opening end portion of the steel pipe P with a special shape.

Accordingly, it is possible to effectively press a part of an opening end portion of the steel pipe P with a special shape on the side to be expanded. For this reason, it is possible to prevent that unnecessary stress is generated in the steel pipe P with a special shape by a pressing load that is exerted on other opening end portions of the steel pipe P with a special shape that are not required to be pressed.

(5) In the steel pipe expanding device 10 according to this embodiment, in the process where the punch 12 is inserted into the steel pipe P with a special shape, as shown in FIG. 6, the control unit 20 controls the pressing force of the side mold 21 to start increasing at the same timing as the timing where the thickness of the steel pipe P with a special shape starts decreasing.

Accordingly, since the pressing force of the side mold 21 on the opening end portion to suppress local excess thickness reduction is increased nearly at the same time as start of thickness reduction, it is possible to more effectively prevent that the thickness is excessively reduced in a particular location.

(6) In the steel pipe expanding device 10 according to this embodiment, as shown in FIGS. 5(*a*) and 5(*b*), the steel pipe P with a special shape is used as a member to be expanded.

Even in the case where a steel pipe with a special shape in section is thus expanded which is not getting evenly thinner and as a result is generally the difficult to be expanded, as discussed above, since the opening end portion is pressed by using the side mold 21, the molding limit can be wider. Therefore, it is possible to excellently expand the pipe.

Other Embodiments

The foregoing description has described one exemplary embodiment according to the present invention. However, the present invention is not limited to the foregoing embodiment. Various changes and modifications can be made without departing from the spirit of the present invention.

(A) In the foregoing embodiment, it has been illustratively described that the timing where the thickness of the steel pipe P with a special shape starts decreasing is specified based on the variation of the pressing force in insertion of the punch 12 into the steel pipe P with a special shape, the timing being used to determine the timing to increase the pressing force of the side mold 21. However, the present invention is not limited to this.

For example, the timing of the thickness reduction may be specified based on control of the insertion stroke and the insertion speed of the punch, control of the insertion speed of the punch and elapsed time from the insertion start, direct control of the thickness of the steel pipe, and so on.

(B) In the foregoing embodiment, as shown in FIG. 3(*b*), etc., it has been illustratively described that the steel pipe P with a special shape is expanded which has a generally rectangular shape in section. However, the present invention is not limited to this.

For example, also in the case where a part of a round steel pipe with a round shape in section is expanded, or in the case where the whole end of such a round steel pipe is eccentrically expanded so that the whole end is expanded outward about a point other than the center of the pipe, when the molding method according to the present invention is applied to these cases, it is possible to provide effects similar to the aforementioned effects.

Figure 10:
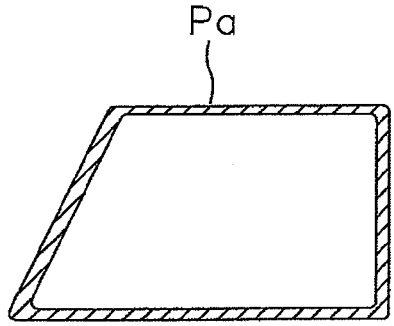
FIGS. 10A to 10C are cross-sectional views showing the cross-sectional shapes of steel pipes with special shapes that are expanded by pipe expanding methods according to other embodiments of the present invention.
Figure 10:
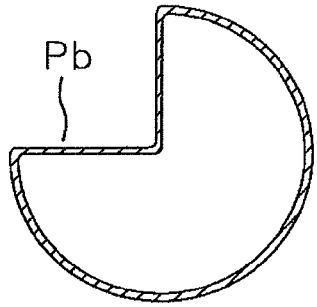
Figure 10:
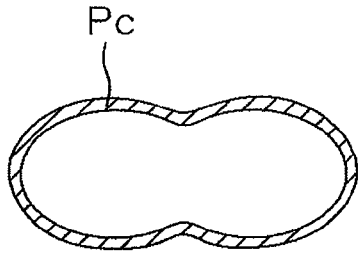

Pipes Pa to Pc with various types of out-of-round shape in section can be expanded specifically such as the pipe Pa with a generally trapezoidal shape in section shown in FIG. 10(*a*), the pipe Pb with a special shape that has a partially recessed round shape in section shown in FIG. 10(*b*), the pipe Pc with a special shape that has a connected-two-oval shape in section shown in FIG. 10(*c*).

(C) In the foregoing embodiment, as shown in FIG. 6, it has been illustratively described that the control unit 20 controls the pressure force of the side mold 21 so as to, after increasing the pressure force of the side mold 21 at a constant ratio to a middle vale, hold the pressure force fixed, and then to start increasing the pressure force again at the timing where the thickness of a steel pipe starts decreasing. However, the present invention is not limited to this.

For example, the pressure force of the side mold may be increased in a multi-step manner instead of a constant increase manner.

In this case, it is also possible to provide an effect similar to the aforementioned effect that can widen the molding limit in pipe expanding for a steel pipe with a special shape and the like.

(D) In the foregoing embodiment, as shown in FIG. 3(*a*), etc., it has been illustratively described that the die 13 is used to expand the steel pipe P with a special shape. However, the present invention is not limited to this.

For example, pipes can be expanded without using the die. However, in terms of formation at a high degree of precision, it is preferable that the die is used to expand steel pipes as in the foregoing embodiment.

(E) In the foregoing embodiment, it has been illustratively described that the steel pipe P with a special shape that is expanded is bent in the stretch bending process is used as a frame support pole that composes a cab installed on a hydraulic excavator or the like. However, the present invention is not limited to this.

For example, instead of a frame support pole for a cab, needless to say, the present invention can be applied to pipe expanding for steel pipes that are used for other applications.

A pipe expanding method for a steel pipe according to the present invention can be widely applied to pipe expanding for various types of material pipes since the present invention provides an effect that can widen the molding limit in pipe expanding for pipes which in turn can provide a molding method that is available for pipe expanding for steel pipes with special shapes, for example.

The invention claimed is:

1. A pipe expanding method for a steel pipe comprising:

inserting a punch for pipe expanding from an opening end portion of the steel pipe;

pressing a part of an axial end surface of the opening end portion of the steel pipe in an insertion direction of the punch when the punch is inserted from the opening end portion of the steel pipe, the pressing of the part of the axial end surface of the opening end portion of the steel pipe being started before a maximum diameter portion of the punch is inserted into the steel pipe; and expanding, by the punch, one side of the steel pipe corresponding to the part of the axial end surface of the open end portion of the steel pipe while the part of the axial end surface of the opening end portion of the steel pipe is pressed in the insertion direction of the punch, the pressing of the opening end portion including pressing the part of the axial end surface of the opening end portion of the steel pipe on the side to be expanded by using a generally U-shaped mold having a generally U-shaped cross-section in a plane perpendicular to the insertion direction of the punch.

2. The pipe expanding method for a steel pipe according to claim 1, wherein the expanding of the one side of the steel pipe includes expanding the one side of the steel pipe by the punch in the state where parallel surfaces of the steel pipe are maintained in parallel while the part of the axial end surface of the opening end portion of the steel pipe is pressed in the insertion direction of the punch.

3. The pipe expanding method for a steel pipe according to claim 2, wherein the pressing of the part of the axial end surface of the opening end portion includes increasing a pressing force which presses the opening end portion of the steel pipe when a thickness of the steel pipe starts decreasing.

4. The pipe expanding method for a steel pipe according to claim 3, wherein the pressing of the part of the axial end surface of the opening end portion includes increasing the pressing force on the opening end portion to a first predetermined pressure, holding the first predetermined pressure until the thickness of the steel pipe starts decreasing, and increasing the pressing force on the opening end portion to a second predetermined pressure when the thickness starts decreasing.

5. The pipe expanding method for a steel pipe according to claim 2, wherein the steel pipe has a special shape in cross-section after the steel pipe has been expanded.

6. The pipe expanding method for a steel pipe according to claim 1, wherein the pressing of the part of the axial end surface of the opening end portion includes increasing a pressing force which presses the opening end portion of the steel pipe when a thickness of the steel pipe starts decreasing.

7. The pipe expanding method for a steel pipe according to claim 6, wherein the pressing of the part of the axial end surface of the opening end portion includes increasing the pressing force on the opening end portion to a first predetermined pressure, holding the first predetermined pressure until the thickness of the steel pipe starts decreasing, and increasing the pressing force on the opening end portion to a second predetermined pressure when the thickness starts decreasing.

8. The pipe expanding method for a steel pipe according to claim 6, wherein the steel pipe has a special shape in cross-section after the steel pipe has been expanded.

9. The pipe expanding method for a steel pipe according to claim 1, wherein the steel pipe has a special shape in cross-section after the steel pipe has been expanded.

10. A pipe expanding device for a steel pipe comprising:

a punch configured and arranged to expand the steel pipe;

an insertion mechanism configured and arranged to insert the punch from an opening end portion of the steel pipe;

a pressing portion configured and arranged to press a part of an axial end surface of the opening end portion of the steel pipe in an insertion direction of the punch when the punch is inserted from the opening end portion of the steel pipe, the axial end surface defining a free-end edge of the opening end portion of the steel pipe; and a control unit configured to control the pressing portion and the insertion mechanism to expand, by the punch, one side of the steel pipe corresponding to the part of the axial end surface of the open end portion of the steel pipe while the part of the axial end surface of the opening end portion of the steel pipe is pressed in the insertion direction of the punch, the control unit being further configured to control the pressing portion so that the pressing portion starts pressing the part of the axial end surface of the opening end portion of the steel pipe before a maximum diameter portion of the punch is inserted into the steel pipe, the pressing portion being a generally U-shaped mold having a generally U-shaped cross-section in a plane perpendicular to the insertion direction of the punch.

11. The pipe expanding device for a steel pipe according to claim 10, wherein the control unit is further configured to control the insertion mechanism and the pressing portion to increase a pressing force of the pressing portion which presses the part of the axial end surface of the opening end portion of the steel pipe when the thickness of the steel pipe starts decreasing as the punch is inserted into the steel pipe.

12. The pipe expanding device for a steel pipe according to claim 11, wherein the punch includes a first section with a first surface parallel to a direction in which the punch is inserted into the steel pipe, and a second section with a second surface parallel to the first surface of the first section, the second section of the punch further includes a third surface parallel to the first surface of the first section, the second and third surfaces being spaced away at different distances from the first surface of the first section with the second and third surfaces being connected through a tapered section.

13. The pipe expanding device for a steel pipe according to claim 12, wherein the steel pipe has a special shape in cross-section after the steel pipe has been expanded.

14. The pipe expanding device for a steel pipe according to claim 12, wherein the steel pipe has a pair of sides parallel to each other in cross-section before and after the steel pipe is expanded.

15. The pipe expanding device for a steel pipe according to claim 11, wherein the steel pipe has a special shape in cross-section after the steel pipe has been expanded.

16. The pipe expanding device for a steel pipe according to claim 11, wherein the steel pipe has a pair of sides parallel to each other in cross-section before and after the steel pipe is expanded.

17. The pipe expanding device for a steel pipe according to claim 10, wherein the punch includes a first section with a first surface parallel to a direction in which the punch is inserted into the steel pipe, and a second section with a second surface parallel to the first surface of the first section, the second section of the punch further includes a third surface parallel to the first surface of the first section, the second and third surfaces being spaced away at different distances from the first surface of the first section with the second and third surfaces being connected through a tapered section.

18. The pipe expanding device for a steel pipe according to claim 17, wherein the steel pipe has a pair of sides parallel to each other in cross-section before and after the steel pipe is expanded.

19. The pipe expanding device for a steel pipe according to claim 10, wherein the steel pipe has a special shape in cross-section after the steel pipe has been expanded.

20. The pipe expanding device for a steel pipe according to claim 10, wherein the steel pipe has a pair of sides parallel to each other in cross-section before and after the steel pipe is expanded.

* * * * *